343-700 MS AU 251 EX
4/21/87 OR 4,660,047

See Fig. 9

United States Patent [19]

Wolfson et al.

[11] Patent Number: 4,660,047

[45] Date of Patent: Apr. 21, 1987

[54] MICROSTRIP ANTENNA WITH RESONATOR FEED

[75] Inventors: Ronald I. Wolfson, Northridge; William G. Sterns, Canoga Park, both of Calif.

[73] Assignee: ITT Corporation, New York, N.Y.

[21] Appl. No.: 660,176

[22] Filed: Oct. 12, 1984

[51] Int. Cl.[4] ..... H01Q 1/48
[52] U.S. Cl. ..... 343/700 MS
[58] Field of Search ..... 343/700 MS, 829, 830

[56] References Cited

U.S. PATENT DOCUMENTS

| | | | |
|---|---|---|---|
| 4,069,483 | 1/1978 | Kaloi | 343/700 MS |
| 4,242,685 | 12/1980 | Sanford | 343/700 MS |
| 4,415,900 | 11/1983 | Kaloi | 343/700 MS |
| 4,554,549 | 11/1985 | Fassett et al. | 343/700 MS |

*Primary Examiner*—Eli Lieberman
*Attorney, Agent, or Firm*—T. L. Peterson; J. M. May

[57] ABSTRACT

An antenna element including microstrip having a microstrip feed line and ground plane on opposite sides of a substrate, a resonator on the same side of the substrate as the microstrip feed line, and a dipole insulated from the feed line and from the resonator.

3 Claims, 21 Drawing Figures

FIG. 16
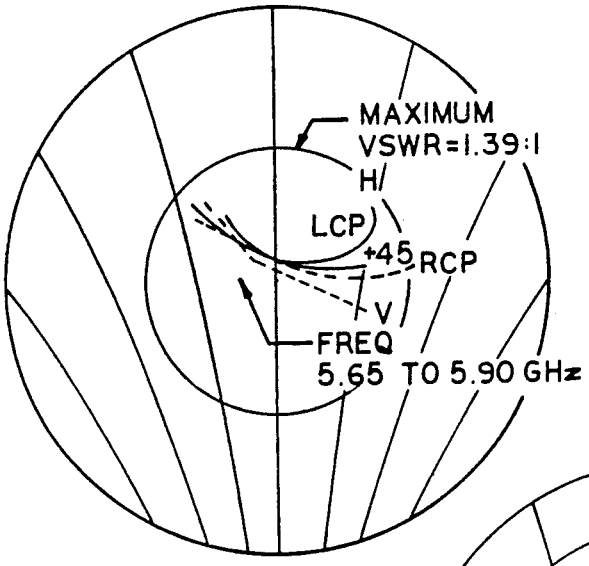
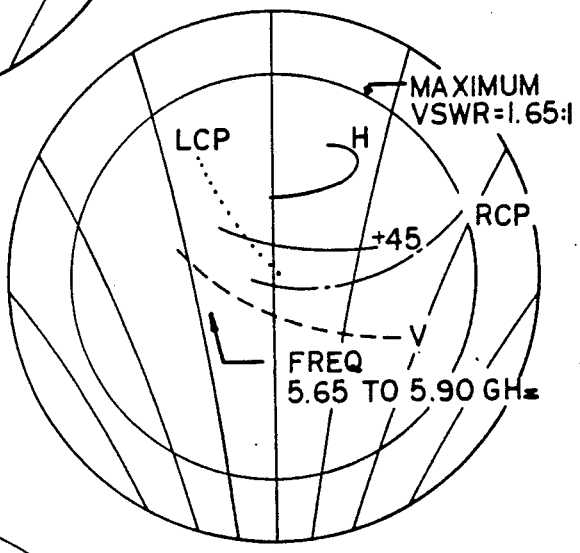
FIG. 17
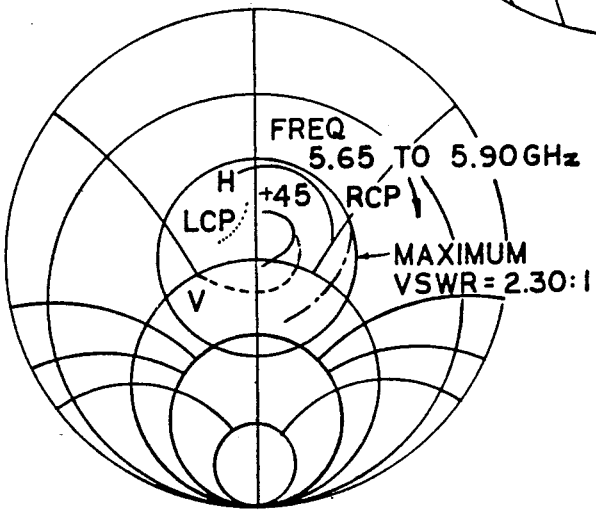
FIG. 18

MICROSTRIP ANTENNA WITH RESONATOR FEED

BACKGROUND OF THE INVENTION

This invention relates means for establishing the propagation of electromagnetic energy, and more particularly to an antenna element.

PRIOR ART STATEMENT

Electromagnetically coupled microstrip dipoles are disclosed in a paper of the same title published in IEEE Transactions on Antennas and Propagation, Vol. AP-29, No. 1, January 1981, and written by H. George Oltman and Donald A. Huebner. Overlapping disclosures exists in this and Oltman U.S. Pat. No. 4,054,874 issued Oct. 18, 1977.

The references cited in the preceding paragraph disclose a microstrip feed line electromagnetically coupled to a dipole. In FIG. 26 of Oltman U.S. Pat. No. 4,054,874, dipoles 101 and 103 are illustrated spatially in quadrature.

Prior art antenna elements have relatively small bandwidths.

SUMMARY OF THE INVENTION

In accordance with the antenna element of the present invention, there is provided a resonator that efficiently couples energy from a microstrip or other feed line to a dipole.

BRIEF DESCRIPTION OF THE DRAWINGS

In the accompanying drawings which illustrate exemplary embodiments of the present invention:

FIG. 16 is the input admittance of a vertical column of eight radiators at 0° azimuth scan (8×8 elements of the array of FIG. 13);

FIG. 17 is the input admittance of a vertical column of eight radiators at 20.7° azimuth scan (8×8 elements of the array of FIG. 13);

FIG. 18 is the input admittance of a vertical column of eight radiators at 45° azimuth scan (8×8 elements of the array of FIG. 13);

DESCRIPTION OF THE PREFERRED EMBODIMENTS

Figure 1:
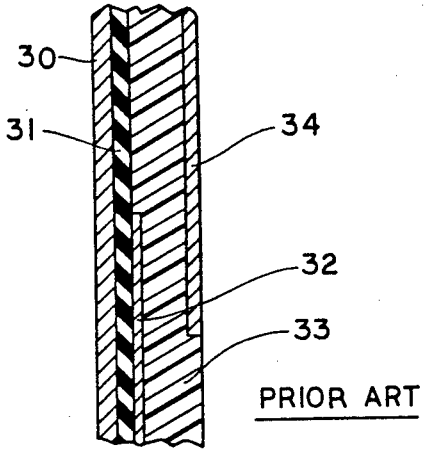
FIG. 1 is a vertical sectional view through a length of microstrip with a conventional antenna element associated therewith taken on the line 1—1, shown in FIG. 2.

In FIG. 1, a conventional structure is shown including a microstrip conductor providing a ground plane is shown at 30 having a conventional substrate 31 bonded thereto. A microstrip feed line 32 is bonded to dielectric substrate 31. A conventional closed cell foam dielectric spacer 33 is bonded to and over substrate 31 and to and over microstrip feedline 32. A dipole radiator 34 is bonded to spacer 33.

Figure 2:
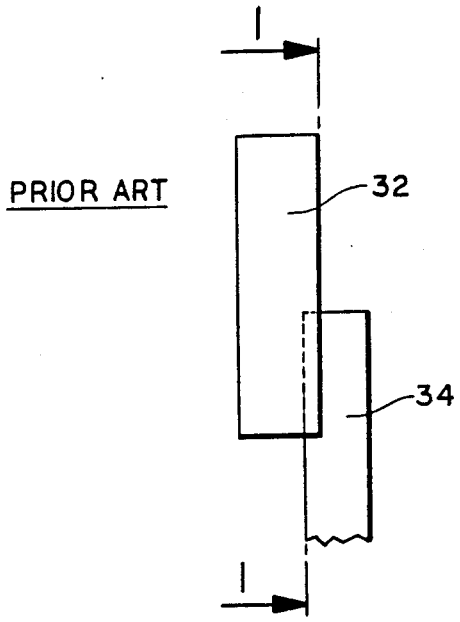
FIG. 2 is a right side elevational view of only microstrip feed line and dipole portions shown in FIG. 1.

FIG. 2 does not show conductor 30, substrate 31 or spacer 33, but does show dipole 34 and microstrip feed line 32 and their relative positions.

Figure 3:
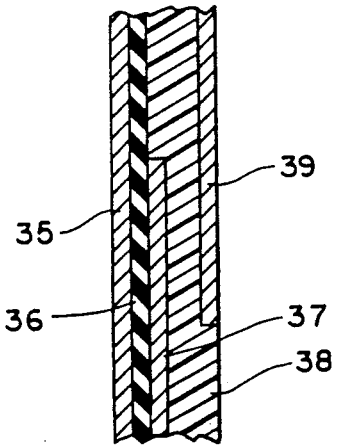
FIG. 3 is a vertical sectional view through a length of microstrip with an antenna element of the present invention associated therewith taken on the line 3—3 shown in FIG. 4.

In FIG. 3, one embodiment of the present invention is shown including a microstrip conductor providing a ground plane at 35. A dielectric substrate is shown at 36. A resonator is shown at 37. A dielectric spacer is shown at 38. A conductive dipole radiator is shown at 39.

Figure 4:
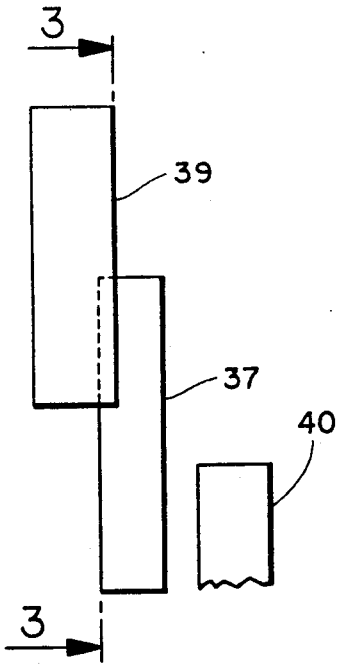
FIG. 4 is a right side elevational view of only microstrip feed line, dipole and resonator portions shown in FIG. 3.

Dipole 39 is shown in FIG. 4 with a microstrip feed line 40 and resonator 37.

Substrate 36 is bonded to conductor 35, spacer 38, resonator 37 and microstrip feed line 40. Dipole 39 is bonded to spacer 38.

Dipole 39, resonator 37 and microstrip feed line 40 may all be thin in comparison to their widths and lengths, as shown. Preferably, resonator 37 has a loaded Q to match the Q of dipole 39.

Microstrip 40 and resonator 37 may or may not have the same thickness and/or width. Both have surfaces which lie wholly in about the same planes between substrates 36 and spacer 38.

Figure 5:
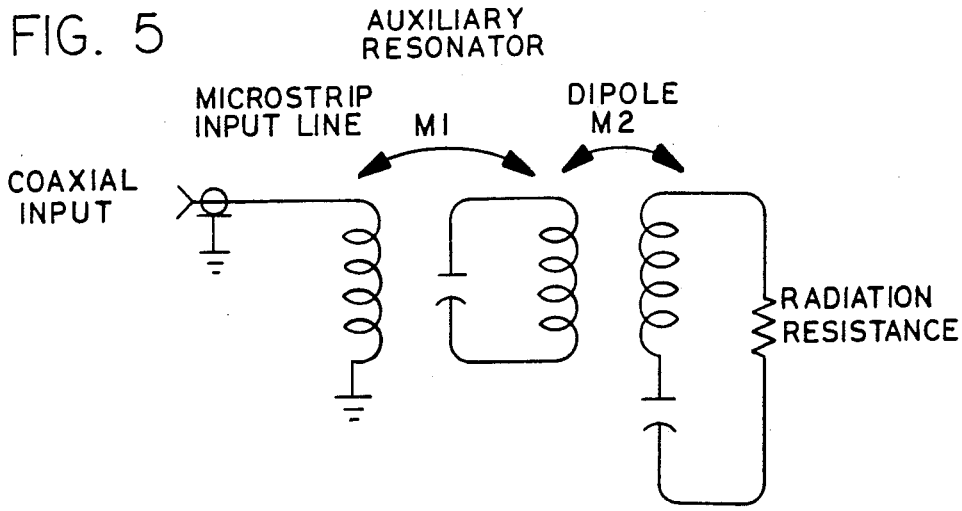
FIG. 5 is a schematic diagram of the equivalent circuit of the electromagnetically coupled dipole with auxiliary resonator of the present invention as shown in FIGS. 3 and 4.

As shown in FIG. 5, the resonator 37 is fed from a coaxial cable.

Figure 8:
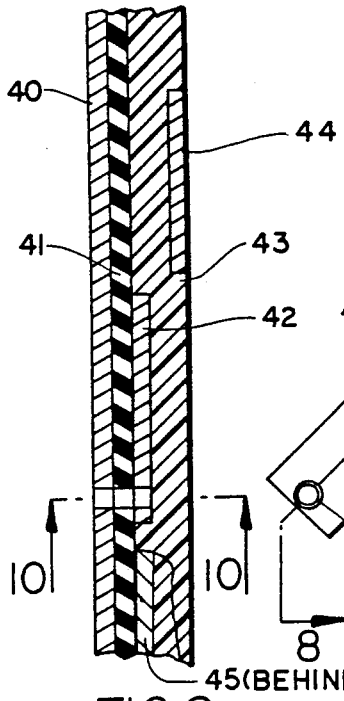
FIG. 8 is a vertical sectional view through a length of microstrip with alternate antenna elements of the present invention associated therewith taken on the line 8—8 shown in FIG. 9.
Figure 9:
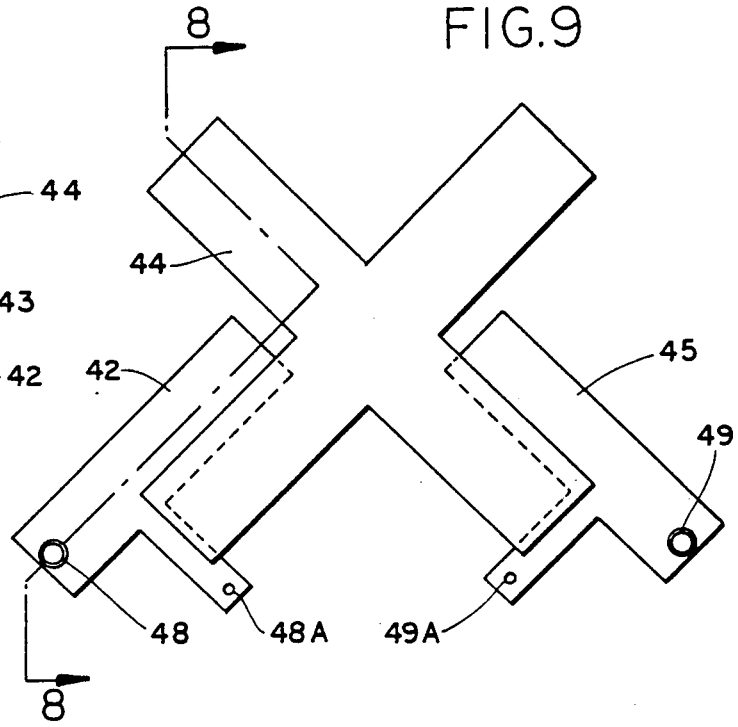
FIG. 9 is a right side elevational of only dipole and resonator portions shown in FIG. 8.
Figure 11:
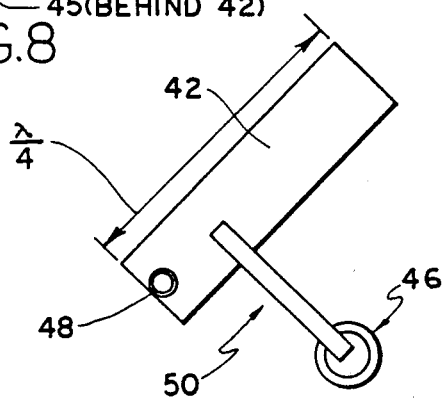
FIG. 11 is a side elevational view of the same type of resonators shown in FIG. 9 illustrating ground locations thereon and points thereon at which they are fed.
Figure 11:
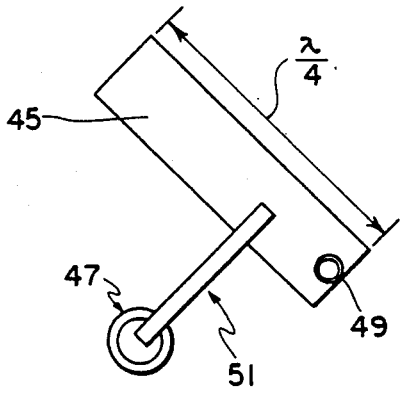

In FIGS. 8 and 9, an alternative embodiment of the present invention is shown including microstrip having a conductive layer 40, a substrate 41, a resonator 42, a dielectric spacer 43 and a cross-dipole radiator 44. Another resonator 45 is also provided as shown in FIG. 9.

Figure 10:
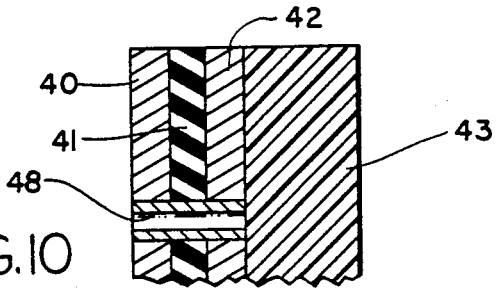
FIG. 10 is an enlarged transverse sectional view taken on the line 10—10 of the structure shown in FIG. 8.

Resonators 42 and 45 are one-quarter wavelength long. A radio frequency (RF) ground is supplied at 48 and 49 at the respective ends of the resonators. Each RF ground is provided with two identical plated through holes, one of which is shown at 48 in FIG. 10. The resonators are fed near the RF ground by microstrip lines 50 and 51. The microstrip lines are fed by coaxial cables 46 and 47.

The voltages in the coaxial lines are equal in amplitude. When in phase, vertical polarization is radiated. When out of phase, horizontal polarization radiates. With a relative phase of ±90°, a circular polarization is achieved.

SUMMARY

Microstrip radiating elements generally have limited application in scanning array antennas because of poor impedance characteristics over operating frequency bands that exceed a few percent, or scan angles wider than about ±20 degrees. Furthermore, if the radiators are dual-polarized elements, polarization purity is often less than 18 dB due to unwanted cross-coupling between the individual radiators or their feed lines.

The following describes a technique for significantly improving the match of a microstrip radiating element over moderate bandwidths, and describes the performance of a dual-polarized C-band radiator in an 8×8 element array.

A class of printed circuit radiators consisting of a dipole that is electromagnetically coupled (EMC) to a microstrip feed line has been recently described in the prior art, as aforesaid. The main advantage of this approach over more conventional designs is that the dipole can be located above the ground plane to optimize bandwidth and efficiency, while simultaneously reducing parasitic radiation from the microstrip feed line. The basic prior art EMC dipole configuration is illustrated in FIGS. 1 and 2. Although bandwidth of this circuit is readily optimized in practice, it is still restricted to the single-tuned response characteristic of a dipole.

Figure 6:
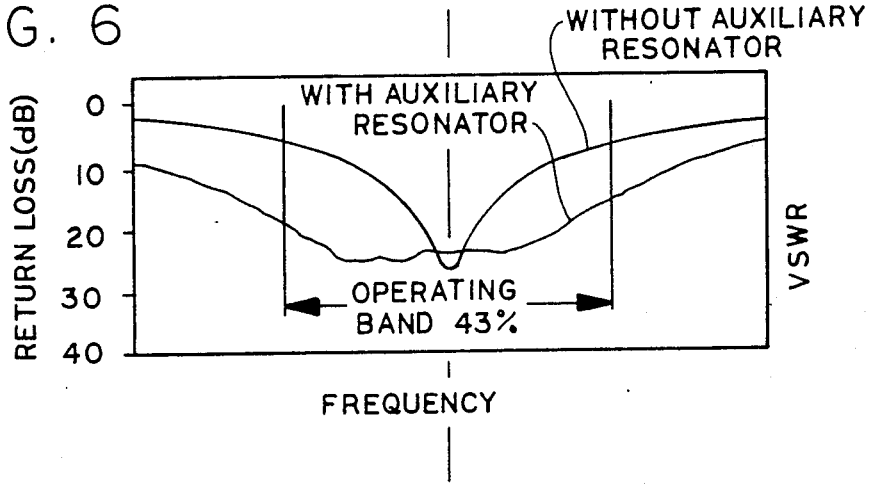
FIG. 6 is a graph of input match versus frequency of the invention shown in FIGS. 3 and 4 and shows the improvement over the prior art.
Figure 12:
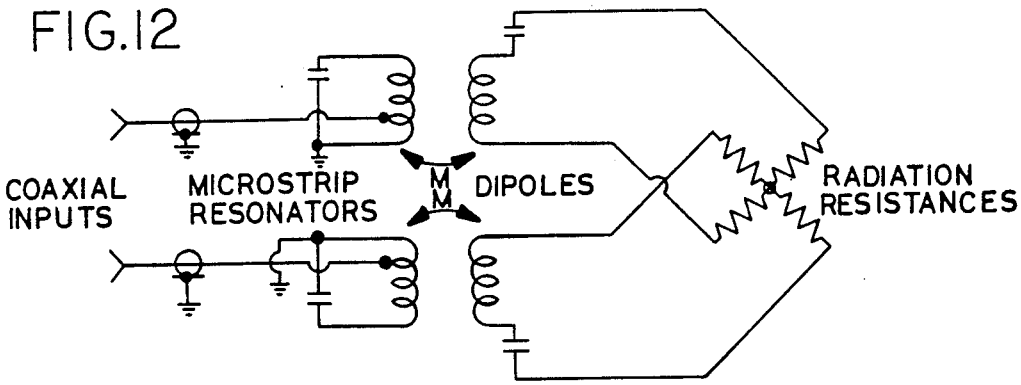
FIG. 12 is a schematic diagram of the equivalent circuit of the radiator and resonators of FIGS. 9 and 11.
Figure 7:
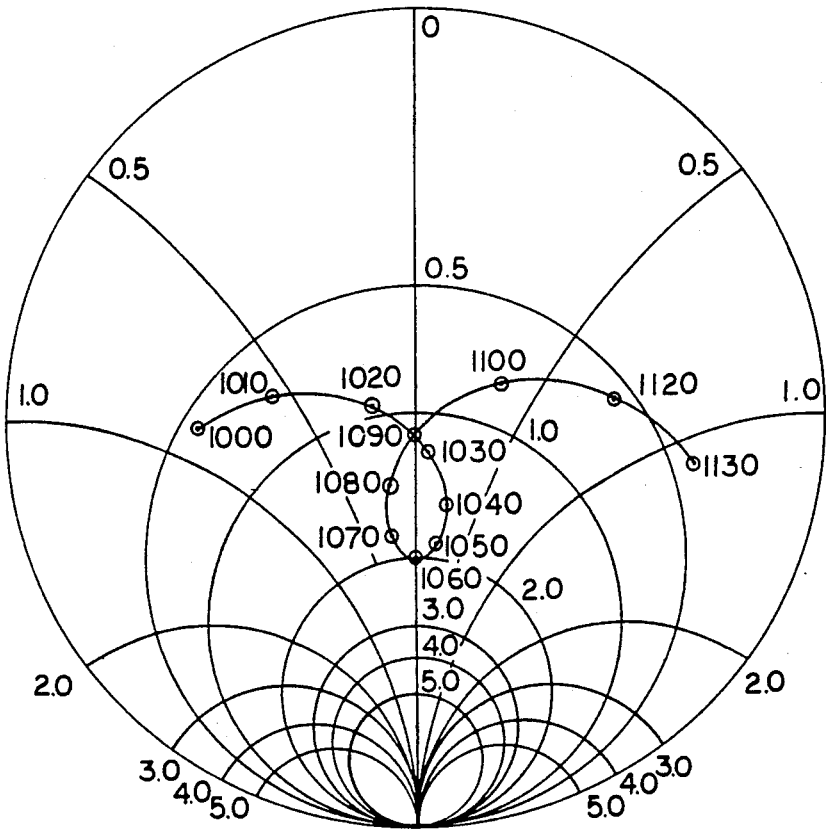
FIG. 7 is a graph of the input admittance of a radiator designed in accordance with this invention.

In accordance with the present invention, a significantly improvement in bandwidth can be realized by the addition of the resonator 37 or 42 and/or 45 or the resonant circuit or auxiliary resonant circuit located between the microstrip feed line 40 and dipole radiator 39, as shown in FIGS. 3 and 4. If the loaded Q of the auxiliary resonator is made equal to that of the dipole, and the proper values of coupling are selected, the double-tuned response shown in FIG. 6 is obtained. For an input voltage standing wave ratio (VSWR) of 1.5:1, the addition of the auxiliary resonator 37 increases the bandwidth of the radiator from about 1.5 to 5.5 percent.

The cross-dipole radiator shown in FIGS. 8–12 covers the freqency range of (5.65 to 5.90) GHz. For this application, best performance is realized with a variation of the auxiliary resonator. One end is RF grounded (FIGS. 8–12), and the microstrip input line is a direct tap rather than coupled electromagnetically. This configuration, which has the equivalent circuit shown in FIG. 12, leads to a geometry whereby unwanted cross-coupling between the closely located feed lines and auxiliary resonators is kept to a minimum.

The construction procedure includes the following steps: determine the length and width of the dipole; find the length, width, and tap point of the auxiliary resonator; and then adjust the location and height of the dipole over the resonator for best VSWR and radiation characteristics. As the dipoles are orthogonal, and thus electrically independent, this optimization process can also be accomplished with a single dipole (FIGS. 3 and 4).

Figure 13:
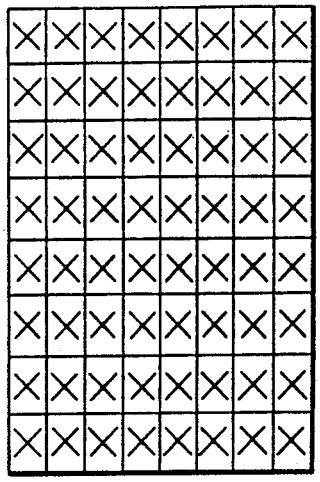
FIG. 13 is a front elevational view of an array of cross-dipole radiators.

After the construction of the isolated cross-dipole radiator has been completed, an 8×8 element array can be built so that the effects of mutual coupling can be observed, and final modifications made to optimize the radiator in the array environment. FIG. 13 shows this array.

Figure 14:
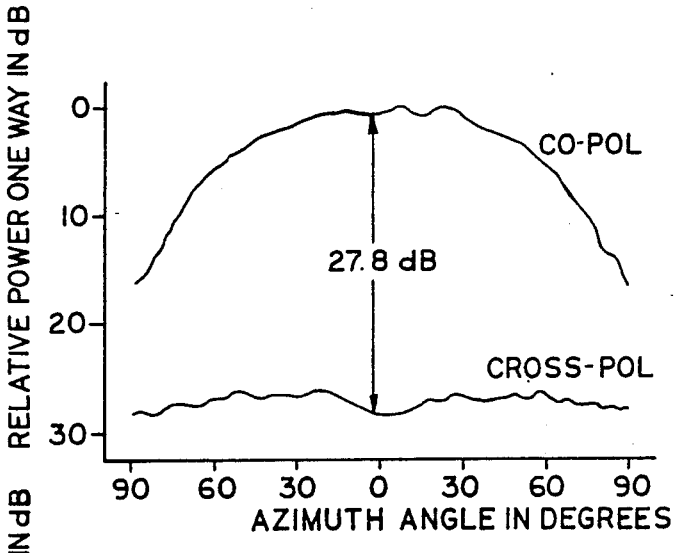
FIG. 14 is an active element azimuth pattern at 5.775 GHz for horizontal polarization (in FIG. 13)
Figure 15:
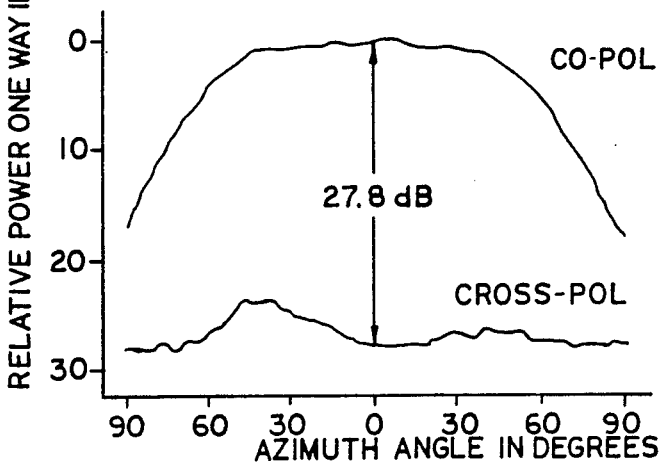
FIG. 15 is an active element azimuth pattern at 5.775 GHz for vertical polarization (in FIG. 13)

The active element azimuth patterns for horizontal and vertical polarization are shown in FIGS. 14 and 15. Coverage is excellent out to ±45 degrees, the azimuth scan limits for which this radiator was developed.

Input admittance (reference plane at resonator input) over the operating frequency band of a vertical column of eight radiators is shown in FIGS. 16–18 for five polarizations: horizontal, vertical, +45 degrees, right-hand circular and lefthand circular. Azimuth scan angle is 0 degrees, 20.7 degrees, and 45 degrees, respectively. The VSWR of 2.3:1 at 45 degrees scan could be improved at the expense of the VSWR at closer-in scan angles; however, this may not be desirable for the intended application.

Figure 19:
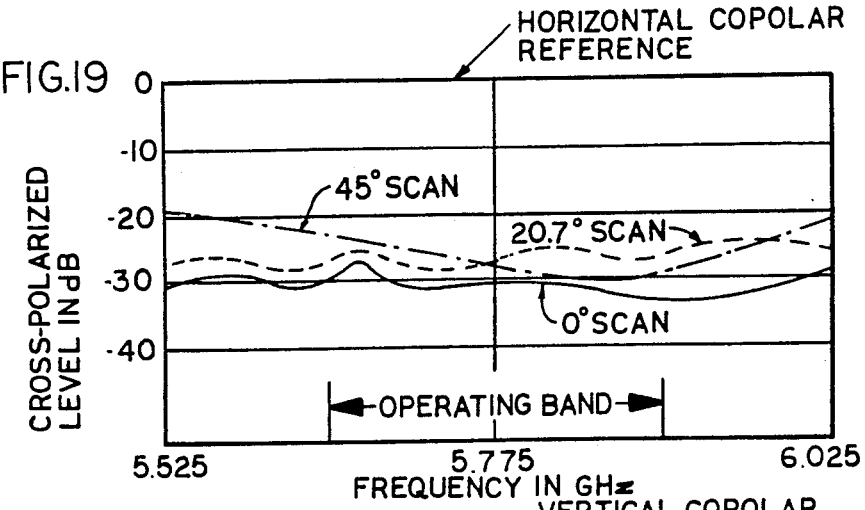
FIG. 19 is a graph showing horizontal polarization purity regarding the array of FIG. 13.
Figure 20:
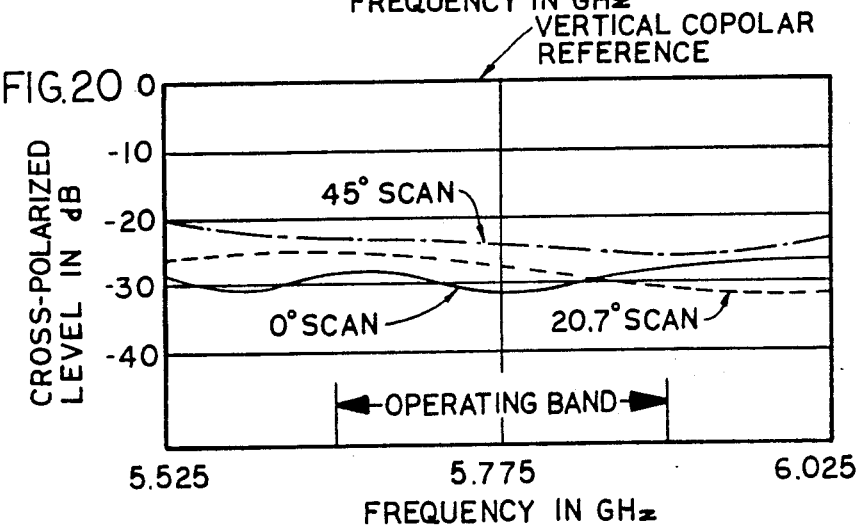
FIG. 20 is a graph showing vertical polarization purity regarding the array of FIG. 13.
Figure 21:
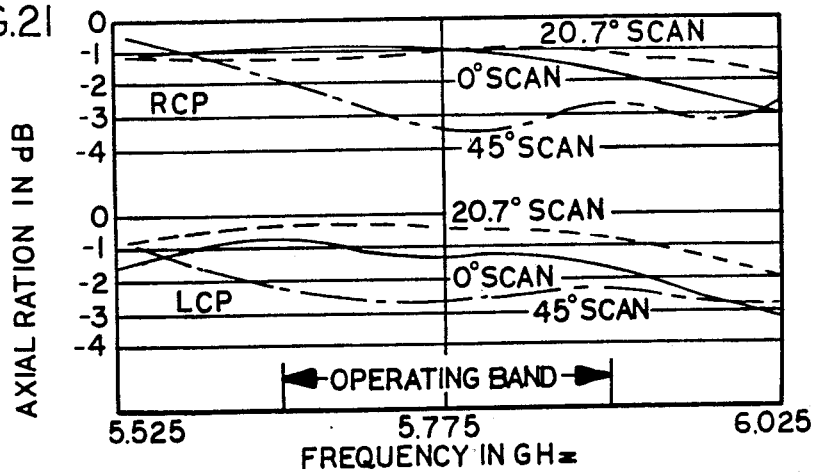
FIG. 21 is a graph showing the circular polarization axial ratio.

The polarization characteristics of the 8×8 element array are shown in FIGS. 19, 20 and 21 for horizontal, vertical and circular polarization, respectively.

CONCLUSIONS

A technique for significantly improving bandwidth of an EMC microstrip radiator by exciting it with an auxiliary resonator has been disclosed. Data on a C-band cross-dipole radiator measured in an 8×8 element array has also been disclosed.

An input match better than 2.30:1 can be obtained for all polarizations over a 4.3 percent bandwidth and ±45 degrees azimuth scan, and 1.65:1 over ±20.7 degrees azimuth scan.

Polarization purity of about 25 dB can be obtained for linear polarization over the frequency operating band and ±45 degrees azimuth scan. For circular polarization, axial ratio of about 1 dB can be achieved for ±20.7 degrees azimuth scan, with about 3 dB at ±45 degrees azimuth scan.

The performance disclosed herein thus represents a substantial improvement over that reported in the prior art for similar microstrip radiators.

What is claimed is:

1. A radiating element comprising:

a microstrip including a ground plane first conductor;

a dielectric microstrip substrate having first and second opposite sides, said first substrate side being bonded to said first conductor;

a conductive resonator resident intermediate a microstrip feed line and a conductive dipole, said microstrip feed line spaced from said conductive resonator, said conductive resonator and said microstrip feed line being bonded to said second substrate side;

a dielectric spacer having first and second opposite sides, said first spacer side being bonded to and over said second substrate side, to and over said conductive resonator and to and over said microstrip feed line; said conductive dipole being bonded to said dielectric spacer second side and spaced from said conductive resonator for optimizing bandwidth and efficiency of the radiating element.

2. The invention as defined in claim 1, wherein said first conductor, said conductive resonator, said conductive dipole and said microstrip feed line are all thin and long in comparison to their widths.

3. The invention as defined in claim 2, wherein said conductive resonator has a loaded Q thereof being equal to the Q of said conductive dipole.

* * * * *